United States Patent [19]

Rousseau

[11] Patent Number: 4,967,733

[45] Date of Patent: Nov. 6, 1990

[54] LIFTING CARRIAGE

[76] Inventor: Yvon J. Rousseau, 2200, Bedard, Longueuil, Quebec, Canada, J4N 1B3

[21] Appl. No.: 421,842

[22] Filed: Oct. 16, 1989

[51] Int. Cl.[5] ..... E04B 1/20

[52] U.S. Cl. ..... 182/13; 182/16; 182/63; 182/141

[58] Field of Search ..... 182/12–17, 182/63, 141, 148, 178

[56] References Cited

U.S. PATENT DOCUMENTS

| | | | |
|---|---|---|---|
| 467,096 | 1/1892 | Harper | 182/148 |
| 548,752 | 10/1895 | Gentry | 182/148 |
| 571,864 | 11/1896 | Parkhurst | 182/148 |
| 2,573,575 | 10/1951 | Keroson | 182/13 |
| 2,695,818 | 11/1954 | Rives | 182/13 |
| 3,502,172 | 3/1970 | Ismond | 182/16 |
| 3,548,970 | 12/1970 | Hutchens | 182/141 |
| 3,825,095 | 7/1974 | Clark | 182/17 |
| 3,851,854 | 12/1974 | Roybal | 182/141 |
| 4,592,447 | 6/1986 | Ream | 182/16 |

*Primary Examiner*—Reinaldo P. Machado
*Attorney, Agent, or Firm*—Roland L. Morneau

[57] ABSTRACT

A lifting carriage having a rectangular frame provided with four corner posts for guiding an elevating platform mounted between these posts. Each post has a toothed rack on which a toothed gear mounted on the platform is engaged for raising the platform. The toothed gears ar actuated by a motor mounted on the platform through a power chain. The carriage is mounted on wheels which can be actuated by a motor for horizontally moving the carriage. The carriage is also provided with spinning wheels on its side, whereby, the carriage, when tilted on its side, can be moved sideways. The elevating platform is provided with guiding wheels adapted to abut against the corner posts for allowing a smooth sliding of the elevating platform.

5 Claims, 4 Drawing Sheets

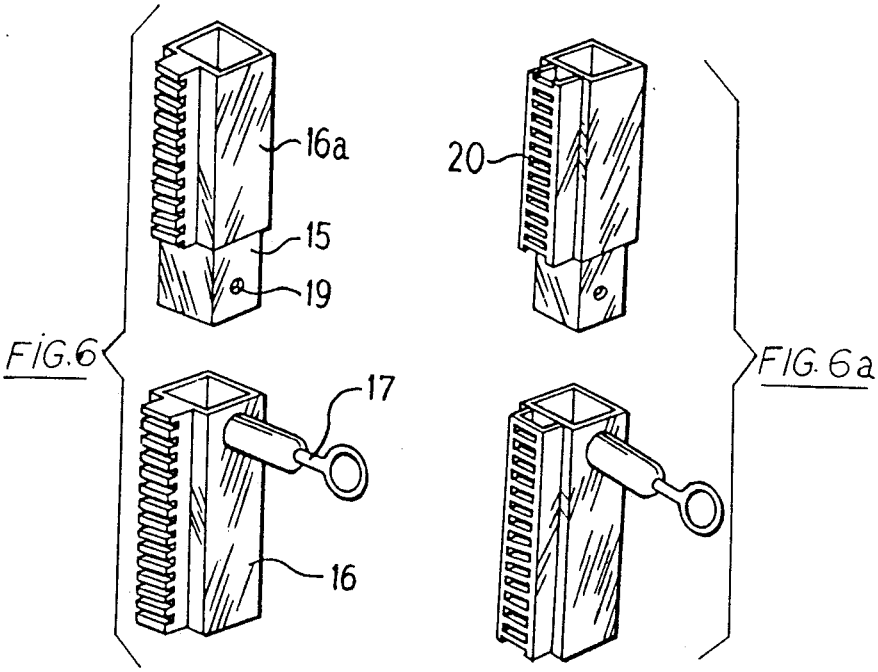
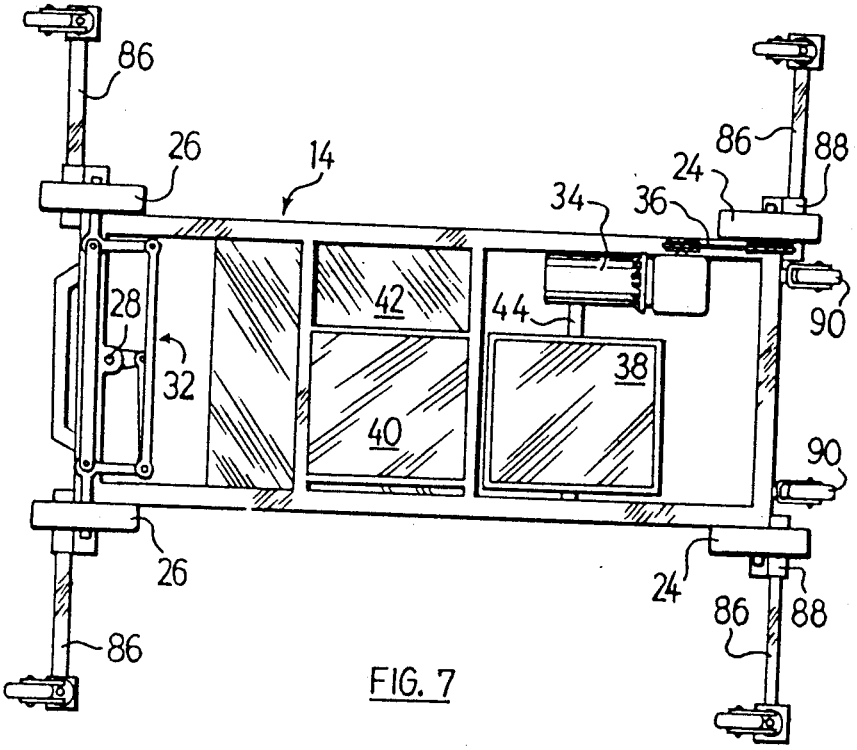
FIG. 7

LIFTING CARRIAGE

BACKGROUND OF THE INVENTION

1. Field of the invention

The present invention relates to a carriage which is provided with an automated lifted platform and adapted to move sideways on a floor.

2. Prior Art

Lifting platforms are known for raising materials and workers to suitable heights commensurate with the level of operation of the workers. They are particularly used on construction sights to maintain the worker at proximity with his work, such as brick laying while preventing him from having to go down a ladder for replenishing his supply of material, or from using a helper to feed him with such material.

The present lifting carriage differentiates from many other types of lifting platforms in that are not of the scissor type such as disclosed in Canadian patents Nos. 974,899, 1,1014.865, and 1,040.550.

It also differentiates from the lift unit described in Canadian patent No. 1,031.707. The latter uses one column comprising two juxtaposed masts with a platform supported by one of the masts and a reeving system for raising the platform.

SUMMARY OF THE INVENTION

The present invention is directed to a carriage adapted to move horizontally on the floor and to raise a platform. The carriage is also adapted to be tilted sideways for going through door openings. The height of the carriage can be extended by superposing additional posts when the work needs to be performed at a higher level.

The lifting carriage comprises a rectangular frame having four corner posts and an elevating platform threadedly engaging each post. Each post has a toothed rack and the platform has a pinion adjacent each rack. The pinions are rotated by a motor through power chains installed under the platform.

BRIEF DESCRIPTION OF THE DRAWINGS

FIGS. 6 and 6*a* are perspective views of a portion of two types of superposed corner posts; and FIG. 7 is a bottom view of the lifting carriage with stabilizing wheels.

DETAILED DESCRIPTION OF THE INVENTION

Figure 1:
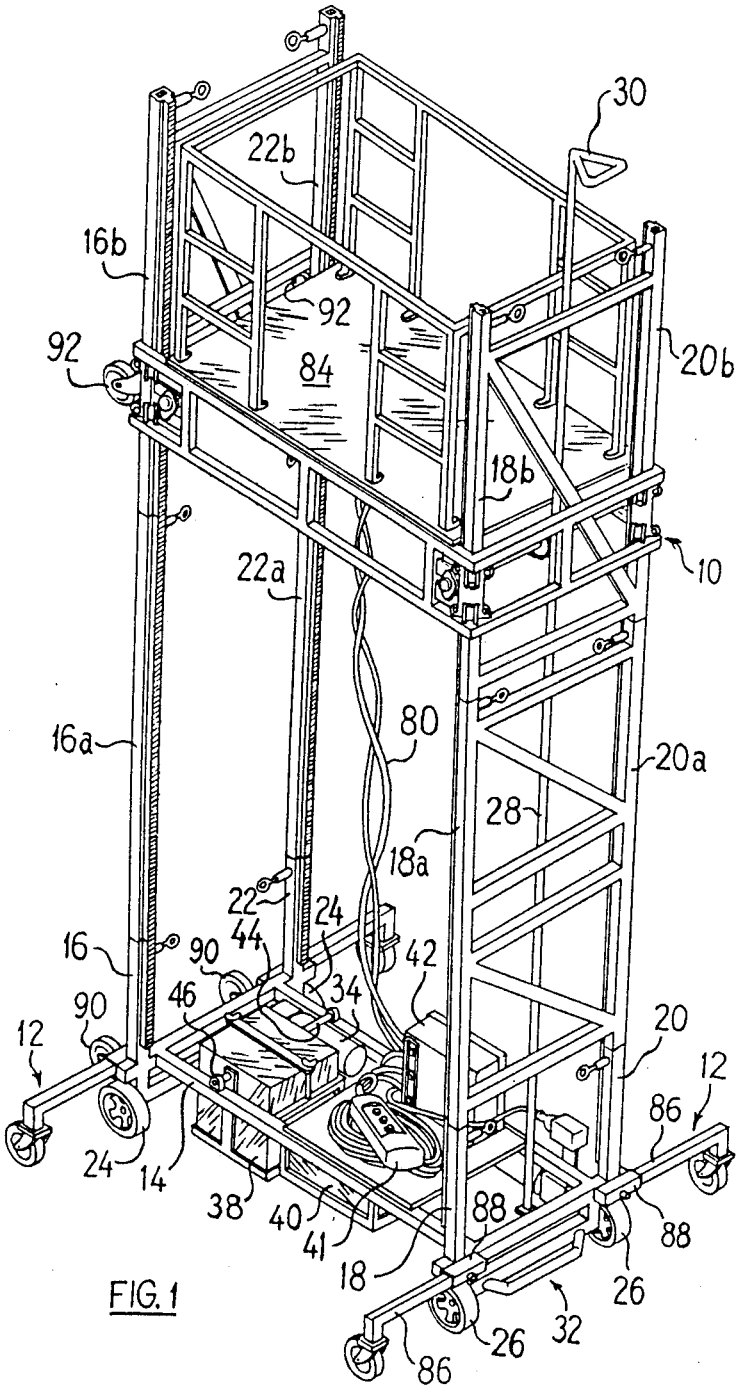
FIG. 1 is a perspective view of a lifting carriage with an elevating platform mounted on extension posts according to the invention.

FIG. 1 illustrates the lifting carriage with the elevating platform 10 in a raised position and with the stabilizing wheels 12 extended on each side of the carriage. The lifting carriage is made of a rectangular frame 14 and four corner posts 16-18-20-22 rigidly secured to the rectangular frame 14. As explained more in detail later, the corner posts 16–22 can be extended upwardly by adding supplemental posts 16*a*–20*a* and to 16*b*–22*b*. The lifting carriage is rotatably supported by four wheels 24 and 26 mounted adjacent each of the four corner posts 16–22. The two front wheels 26 can be steered by a steering column 28 and a steering wheel 30. As shown in FIG. 7, the wheels 26 can be oriented by the steering column 28 through a steering lever mechanism 32 of the parallelogram type.

The wheels 24 are connected to a motor 34 through a power chain arrangement 36 for horizontally moving the carriage.

The rectangular frame 14 is used to support battery 38, a charger 40 for charging the battery 38 and a control center 42 for operating the elevating platform 10 and the motor 34 from a central switch assembly 41.

The battery 38 is suspended from an axle 44 so that when the carriage is tilted, the battery will remain in the same leveling position. The axle 44 is rotatably mounted in spindle housing 46 secured on the surface of the rectangular frame 14.

Figure 2:
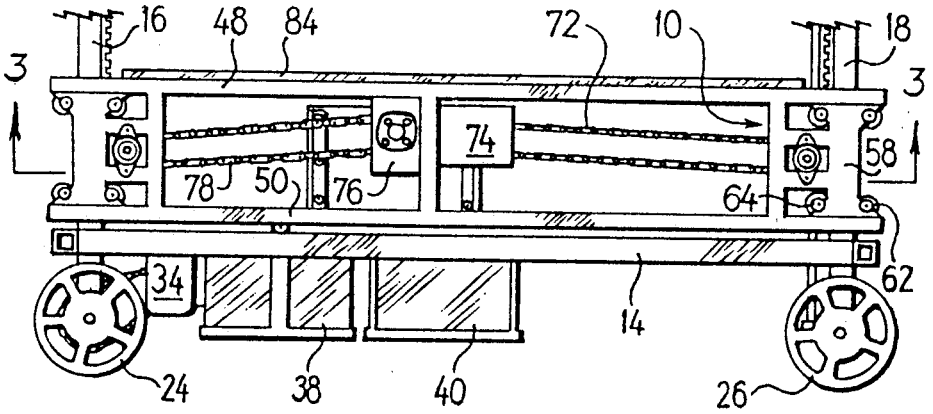
FIG. 2 is a side view of the carriage with the elevating platform at its lowest level.
Figure 4:
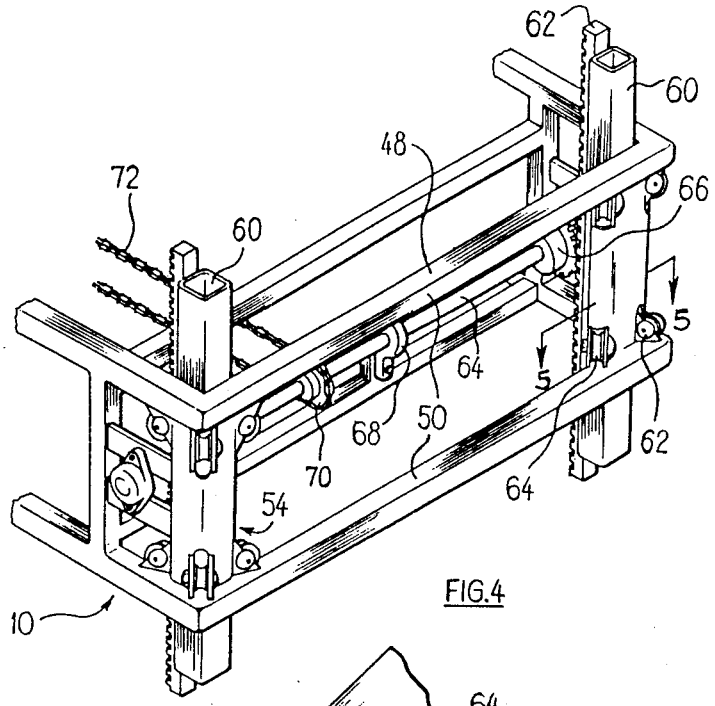
FIG. 4 is a perspective view of one end of the elevating platform mounted on corner posts.
Figure 5:
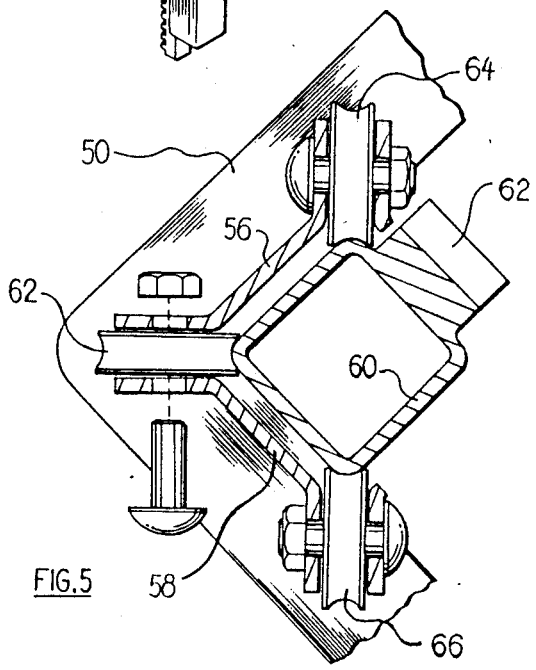
FIG. 5 is a cross-sectional view along line B—B of FIG. 4 showing a corner post surrounded by three guiding wheels.

In FIG. 2, the elevating platform 10 is located adjacent the rectangular frame 14 in its lowermost position. The elevating platform 10 has a contour which is substantially similar to the contour of the rectangular frame 14 and is made of two superposed peripheral beams 48 and 50 spaced by four columns at each corner of the elevating platform. Each column such as columns 52 and 54 shown in FIG. 4 are made of a pair of orthogonally disposed plates 56 and 58 forming the corner of the platform. Each corner is built and operates in a similar manner a 52 by having a post 60 upwardly erected in between said plates 56 and 58. Three guiding wheels 62, 64 and 66 are mounted on the plates 56 and 58 and are adapted to extend, in part, inside the plates 56 and 58 to rotatably abut against the post 60 as shown in FIGS. 4 and 5. Similarly arranged guiding wheels are fixed to the plates 56 and 58 adjacent the beam 48 for positively abutting against the post 60. This same abutting effect is exerted against each of the four corner posts secured to the rectangular frame 14.

Each of the four corner posts 60 is provided with an upwardly secured toothed rack 62 facing inside the peripheral beams 48 and 50.

Figure 3:
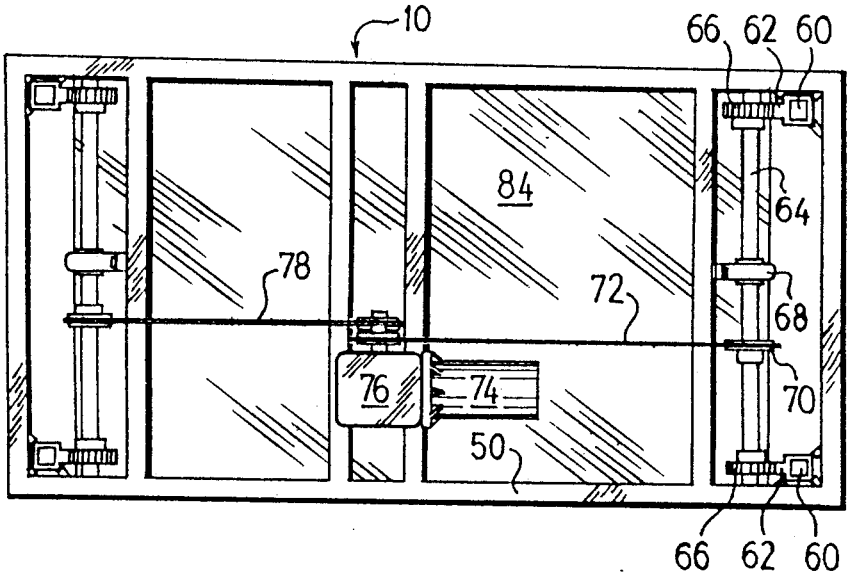
FIG. 3 is a sectional view of the carriage along line A—A of FIG. 2.

A rotatable shaft 64 is secured at both ends to the elevating platform 10 and rotatably support at each end a sprocket wheel 66 which is located so as to positively engage into the toothed rack 62. The shaft 64 is further immobilized, in translation, by a clamping arrangement 68 which allows the shaft to rotate therethrough. The shaft 64 supports a sprocket wheel 70 which is actuated by a power chain 72 and a motor 74 through a gear box 76. The driving system which has just been described relative to the right hand side of FIGS. 2 and 3, corresponds to the driving system of the left hand side through the power chain 78.

The motor 74 is actuated through the control system 42 by the switch assembly 41 usually manipulated by an operator standing on a board 84 over the elevating platform 10. When the motor 74 is actuated, the power chain 72 rotates the shaft 64 which allows the pinions or sprocket gears 66 to vertically move along the toothed rack 62. The elevating platform 10 is accordingly raised or lowered inside the four posts 16–22. The original posts 16–22 secured to the rectangular frame 14 are usually not much higher than the height of the elevating platform for the reasons explained later. If one wants to raise the platform at higher levels, additional posts such as 16a–22a and 16b–22b are superposed to the original corner posts as illustrated in FIG. 6. The post 16a has a stub 15 which fits into the post 16. A transversal sliding key 17 in post 16 is usually spring actuated and is made to project through the aperture 19 in the stub 15 for locking both posts together. An alternative arrangement for the toothed rack is shown in FIG. 6a wherein the teeth are substituted by slots 20 adapted to receive teeth of the sprocket gears 66.

In order to be more fully functional, the wheels 26 can be steered by the steering wheel 30. Accordingly, when the platform 84 is loaded, the operator can move upwardly at the desired height, sidewardly along a desired path and even move through a plurality of paths by steering his way through various passages.

When extension posts such as 16b–22b are added, and when additional weight is added on the platform 84, it may be safer to laterally extend the stabilizing wheels 12. Such wheels 12 are mounted on bars 86 which are adapted to slide in sleeves 88 secured to the frame 14.

The carriage is also preferably provided with a set of four wheels extending on one of its sides and preferably on one of its narrower sides. A set of two side wheels 90 (FIG. 1) are secured on the side of the rectangular frame 14 and extend outside the periphery of the latter. Another set of two side wheels 92 are secured to the elevating platform outside the periphery of the latter on the same side of the wheels 90. The side wheels 90 and 92 are used to transport the carriage on its side. This situation occurs when the carriage needs to be transported through doors or narrow passages. In such circumstances, the additional posts 16a–22a and 16b–22b are removed so that the carriage looks substantially like it appears in FIG. 2. Although the side wheels 90 and 92 are not shown in FIG. 2, the carriage is tilted on the two sets of wheels 90 and 92 and since the latter wheels are pivoting wheels, the carriage can move through a narrow passage corresponding to a width slightly larger than the height of the carriage as shown in FIG. 2. It is obvious, for this purpose, that wheels 90 and 92 are pivoting so that the carriage can move sideways.

Carriages of the type described above have been produced having a width of 30 inches and a total height of 90 inches. However, the carriage has a height of about only 24 inches when the elevating platform 10 is in its lowermost position as shown in FIG. 2. Considering that a door may be about 28 to 30 inches wide, the present carriage can be moved through common doors in a house, when standing on wheels 90 and 92. The length of the carriage is shorter than the height of such doors.

The present carriage is very versatile and it can be helpful to workers on the construction fields or for renovation and maintenance purposes. Such a carriage can prevent backaches considering that workers do not have to bend or go down ladders or even jump from static scaffoldings. The displacement of the carriage is made with an electrical power supply installed in the carriage. As stated above, the battery 38 is suspended on an axle 44 and will remain leveled when the carriage is tilted on side wheels 90 and 92.

What is claimed is:

1. A lifting carriage comprising a rectangular frame having four corner posts, each of said posts having a square cross-section with sides parallel to the rectangular frame, a rotatable wheel mounted about each of the four corner posts for supporting said carriage on a floor surface, an elevating horizontal platform supported on said frame, said platform having a peripheral beam member surrounding the four corner posts;

a toothed rack member extending upwardly on each of the corner posts, said rack members having a teeth facing each other on adjacent pairs of rack members;

pinion gears mounted on said elevating platform adjacent said toothed rack members for threadedly engaging the latter, adjacent pairs of said pinion members being connected together by a shaft, said pairs of pinion gears engaging one of the pairs of rack members;

guiding wheels mounted on said peripheral beam member, said guiding wheels comprising three wheels rotatably abutting against each of the corner posts, each of the said wheels facing a corner of the square cross-section of the posts, one of said wheels being mounted relative to said posts in a position opposite said platform;

power means fixed on said lifting carriage for rotating said shafts and for driving said pinions against said rack members and for vertically displacing said elevating platform along said toothed rack members.

2. A lifting carriage as recited in claim 1, wherein said power means comprises a first motor, a battery for actuating said first motor, a tiltable support for holding said first battery on said carriage, said support adapted to maintain said first battery on a level position when the carriage is tilted from a horizontal to a vertical position.

3. A lifting carriage as recited in claim 1, wherein said power means comprises a battery operated motor, a gear box connected to said motor, power chains actuated by said gear box for actuating said shafts and pinions, whereby the latter threadedly engage the rack members for vertically moving said elevating platform.

4. A lifting carriage as recited in claim 1, comprising a first set of two rotatable side wheels mounted on one side of said rectangular frame adjacent the lower end thereof, a second set of rotatable side wheels mounted on said elevating platform, said wheels being located adjacent two adjacent corner posts and extending outside the periphery of said frame in a same vertical plane adjacent said peripheral beam member, said carriage adapted to be rotatably supported by said side wheels when said platform is vertically positioned on said floor surface.

5. A lifting carriage as recited in claim 1, wherein said four corner posts are hollow, said carriage comprising extension corner posts having a square cross-section corresponding to said four corner posts, said extension corner post having extension toothed rack members adapted to continuously extend from the toothed rack members of the four corner posts, means for removably mounting said extension post and rack members vertically over said four posts and rack members, whereby said platform is adapted to vertically move upwardly by engaging said extension rack members.

* * * * *